US010270156B2

(12) United States Patent
Nakano

(10) Patent No.: US 10,270,156 B2
(45) **Date of Patent: *Apr. 23, 2019**

(54) ANTENNA DEVICE AND ELECTRONIC APPARATUS

(71) Applicant: Murata Manufacturing Co., Ltd., Nagaokakyo-shi, Kyoto-fu (JP)

(72) Inventor: Shinichi Nakano, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 126 days.

This patent is subject to a terminal disclaimer.

(21) Appl. No.: 15/253,989

(22) Filed: Sep. 1, 2016

(65) Prior Publication Data

US 2016/0372818 A1 Dec. 22, 2016

Related U.S. Application Data

(63) Continuation of application No. PCT/JP2015/056293, filed on Mar. 4, 2015.

(30) Foreign Application Priority Data

Mar. 7, 2014 (JP) ..... 2014-044808

(51) Int. Cl.
*H01Q 1/24* (2006.01)
*H01Q 7/06* (2006.01)
(Continued)

(52) U.S. Cl.
CPC ..... *H01Q 1/243* (2013.01); *H01Q 1/2208* (2013.01); *H01Q 1/38* (2013.01); *H01Q 1/48* (2013.01);
(Continued)

(58) Field of Classification Search
CPC ..... H01Q 1/243; H01Q 1/38; H01Q 7/00; H01Q 1/22
(Continued)

(56) References Cited

U.S. PATENT DOCUMENTS

2001/0040531 A1* 11/2001 Saito ..... H01Q 1/243 343/895
2008/0252551 A1* 10/2008 Kubo ..... H01Q 1/2208 343/867
(Continued)

FOREIGN PATENT DOCUMENTS

JP 2012-095350 A 5/2012
JP 2012-157079 A 8/2012
(Continued)

OTHER PUBLICATIONS

Official Communication issued in International Patent Application No. PCT/JP2015/056293, dated Apr. 7, 2015.

*Primary Examiner* — Dameon E Levi
*Assistant Examiner* — Collin Dawkins
(74) *Attorney, Agent, or Firm* — Keating & Bennett, LLP

(57) ABSTRACT

Coil conductors each including a coil opening, and a planar conductor are included in an antenna device. The coil conductors are disposed at edge portions of the planar conductor such that winding axes of the coil conductors extend in a normal direction of the planar conductor. The coil conductors are connected such that magnetic fluxes generated at the respective coil conductors are in opposite phase with each other. In a plan view, portions of the plurality of coil conductors overlap the planar conductor and portions of the coil openings do not overlap the planar conductor.

20 Claims, 16 Drawing Sheets

(51) Int. Cl.

| | |
|---|---|
| ***H01Q 1/38*** | (2006.01) |
| ***H01Q 1/48*** | (2006.01) |
| ***H01Q 21/28*** | (2006.01) |
| ***H01Q 1/22*** | (2006.01) |
| ***H01Q 7/00*** | (2006.01) |

(52) U.S. Cl.
CPC ..... *H01Q 7/00* (2013.01); *H01Q 7/06* (2013.01); *H01Q 21/28* (2013.01)

(58) Field of Classification Search
USPC ..... 343/702, 878, 867, 855
See application file for complete search history.

(56) References Cited

U.S. PATENT DOCUMENTS

2009/0096694 A1* 4/2009 Ito ..... G06K 19/07749 343/788
2012/0206239 A1* 8/2012 Ikemoto ..... G06K 7/10346 340/10.1

FOREIGN PATENT DOCUMENTS

JP 2013-168894 A 8/2013
WO 2007/060792 A1 5/2007

* cited by examiner

ANTENNA DEVICE AND ELECTRONIC APPARATUS

CROSS REFERENCE TO RELATED APPLICATIONS

This application claims the benefit of priority to Japanese Patent Application 2014-044808 filed Mar. 7, 2014 and is a Continuation Application of PCT/JP2015/056293 filed on Mar. 4, 2015, the entire contents of each application are hereby incorporated herein by reference.

BACKGROUND OF THE INVENTION

1. Field of the Invention

The present invention relates to an antenna device for use in an RFID system, a near field radio communication system, or the like, and an electronic apparatus including the antenna device.

2. Description of the Related Art

In recent years, a small-size radio communication apparatus such as a cellular phone terminal has been equipped with an RFID system with a 13.56 MHz band such as an NFC (near field radio communication system) in increasing cases. An antenna to be used therein is generally a planar coil antenna, and is attached on the surface of a resin casing of a cellular phone terminal.

However, when the distance between a planar antenna coil and a circuit board included in a cellular phone terminal decreases with thinning of the cellular phone terminal, deterioration of antenna characteristics due to unnecessary coupling between the antenna and the circuit board becomes a problem.

As one antenna device that solves the above-described problem, International Publication No. 2007/060792 discloses an antenna device in which a plurality of coil units each including a winding wound thereon are disposed on side surfaces at both sides across a virtual center line of a cellular phone terminal, and the winding of each coil unit is connected via a conductor such that the winding direction of the winding of each coil unit is the same.

The antenna device disclosed in International Publication No. 2007/060792 has a problem that a plurality of null points (insensible points) occur in a region facing a principal surface of the cellular phone terminal, and thus has a problem that the usability is poor.

SUMMARY OF THE INVENTION

Preferred embodiments of the present invention provide an antenna device which has good communication characteristics even when close to an antenna which is a communication counterpart, in a wide region of an electronic apparatus such as a cellular phone terminal, and an electronic apparatus including the antenna device.

An antenna device according to a preferred embodiment of the present invention includes a plurality of coil conductors each including a coil opening, and a planar conductor.

The plurality of coil conductors are disposed at edge portions of the planar conductor such that winding axes of the coil conductors extend in a normal direction of the planar conductor.

The plurality of coil conductors are connected such that magnetic fluxes generated at the respective coil conductors are in opposite phase with each other.

In a plan view, portions of the plurality of coil conductors overlap the planar conductor and portions of the coil openings do not overlap the planar conductor.

With the above configuration, the coil conductors and the planar conductor mainly magnetically couple with each other, so that the planar conductor defines and functions as a radiator (radiation plate) and each coil conductor defines and functions as a power supply coil for the radiator.

The portions of the plurality of coil conductors that overlap the planar conductor are preferably disposed along an outer edge of the planar conductor in a plan view. Thus, the degree of coupling between each coil conductor and the planar conductor increases, and the effect of the planar conductor as a radiator improves.

At least two coil conductors of the plurality of coil conductors are preferably disposed at positions which are symmetrical about a center line extending in a predetermined direction of the planar conductor, in a plan view. Thus, a peak (hot spot) of gain occurs on the center line of the planar conductor.

At least two coil conductors of the plurality of coil conductors are preferably disposed at positions which are symmetrical about a center point of the planar conductor, in a plan view. Thus, it is possible to increase the interval between the two coil conductors which have point symmetry, and it is possible to expand a range where communication is possible.

Preferably, the planar conductor includes two opposing sides, and includes cutout-shaped portions recessed from each side toward the opposed side, and the coil openings of the respective coil conductors overlap the cutout-shaped portions in a plan view. With this structure, it is possible to dispose each coil conductor inside the planar range of the planar conductor, and thus size reduction of the planar conductor or size increase of an apparatus is avoided.

In the case where the planar conductor includes a principal surface and a bent surface connected to the principal surface, a cutout-shaped portion is preferably provided in the bent surface. Thus, in the case where the planar conductor is a structural material, a decrease in mechanical strength due to formation of the cutout-shaped portion is a significantly reduced or prevented. In addition, since the bent surface is included, the effective area of the planar conductor increases, and a range where communication is possible widens.

A magnetic sheet covering at least a portion of the cutout-shaped portion in a plan view is preferably included. Thus, the cutout-shaped portion is magnetically shielded, so that it is possible to significantly reduce or prevent unnecessary radiation. In addition, in the case where another conductor is close to the coil conductor, it is possible to significantly reduce or prevent influence of this conductor.

An electronic apparatus according to a preferred embodiment of the present invention includes an antenna device and a power supply circuit connected to the antenna device.

The antenna device includes a plurality of coil conductors each including a coil opening, and a planar conductor.

The plurality of coil conductors are disposed at edge portions of the planar conductor such that winding axes of the coil conductors extend in a normal direction of the planar conductor.

The plurality of coil conductors are connected such that magnetic fluxes generated at the respective coil conductors are in opposite phase with each other.

In a plan view, portions of the plurality of coil conductors overlap the planar conductor and portions of the coil openings do not overlap the planar conductor.

The planar conductor defines and functions as a metal portion of a casing.

With the above configuration, it is possible to effectively use, as a radiator, the metal portion of the casing originally included in the electronic apparatus.

Preferably, the metal portion of the casing includes a principal surface and a bent surface connected to the principal surface, a cutout-shaped portion for a device is provided in the bent surface, and the coil opening of at least one coil conductor of the plurality of coil conductors overlaps the cutout-shaped portion. Thus, by using the cutout-shaped portion for the operation button, it is possible to easily dispose a plurality of coil conductors such that portions of the coil conductors overlap the metal portion of the casing and portions of the coil openings do not overlap the metal portion of the casing. That is, it is unnecessary to provide a dedicated cutout-shaped portion in the metal portion of the casing in order to dispose the coil conductors as described above, and thus it is possible to significantly reduce or prevent a decrease in the mechanical strength of the metal portion.

An electronic apparatus according to a preferred embodiment of the present invention includes an antenna device and a power supply circuit connected to the antenna device.

The antenna device includes a plurality of coil conductors each including a coil opening, and a planar conductor.

The plurality of coil conductors are disposed at edge portions of the planar conductor such that winding axes of the coil conductors extend in a normal direction of the planar conductor.

The plurality of coil conductors are connected such that magnetic fluxes generated at the respective coil conductors are in opposite phase with each other.

In a plan view, portions of the plurality of coil conductors overlap the planar conductor and portions of the coil openings do not overlap the planar conductor.

The planar conductor is a portion of a conductor provided on a circuit board.

With the above configuration, it is possible to effectively use, as a radiator, the conductor of the circuit board originally included in the electronic apparatus.

In an antenna device according to a preferred embodiment of the present invention, the plurality of coil conductors and the planar conductor mainly magnetically couple with each other, so that the planar conductor defines and functions as a radiator (radiation plate) and each coil conductor defines and functions as a power supply coil for the radiator. Thus, communication is performed in a state where the planar conductor faces the antenna of the communication counterpart, so that substantially no null point (insensible point) occurs.

In an electronic apparatus according to a preferred embodiment of the present invention, the metal portion of the casing or the conductor of the circuit board originally included in the electronic apparatus also defines and functions as a radiator of the antenna device, and thus it is possible to provide an electronic apparatus which is small in size but includes an antenna device.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a plurality of preferred embodiments of the present invention will be described with reference to the drawings. In each drawing, the same portion or element is designated by the same reference sign. Each preferred embodiment is illustrative, and configurations shown in different preferred embodiments can be partially substituted or combined.

First Preferred Embodiment

Figure 1A:
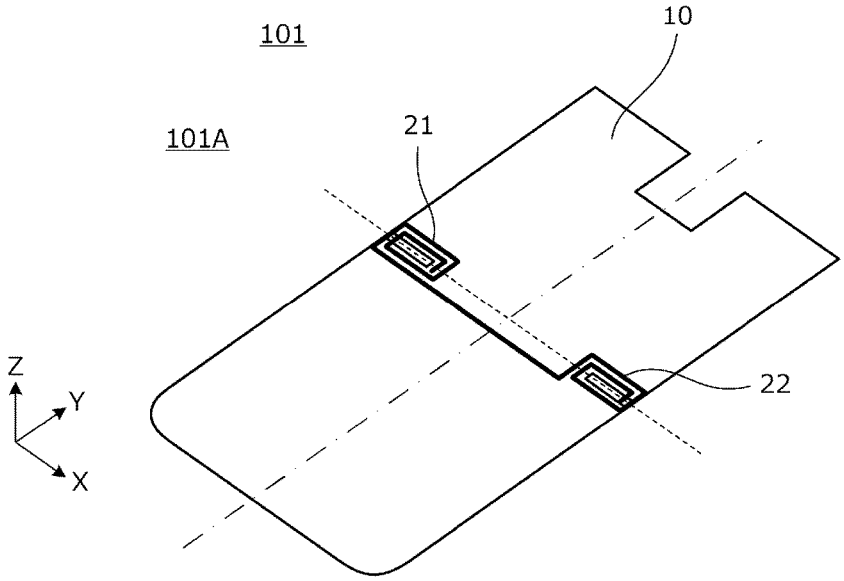
FIGS. 1A and 1B are perspective views of antenna devices according to a first preferred embodiment of the present invention.
Figure 1B:
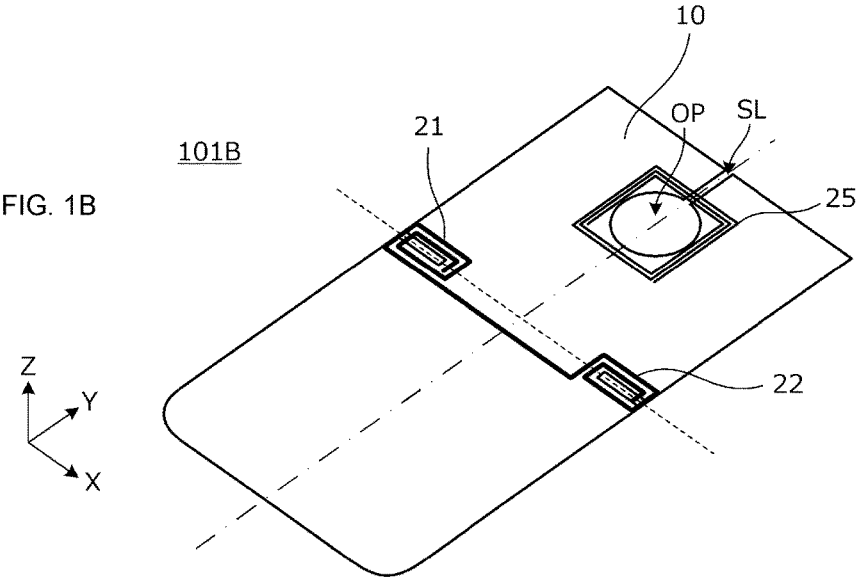

FIGS. 1A and 1B are perspective views of antenna devices 101A and 101B according to a first preferred embodiment of the present invention. First, the antenna device 101A will be mainly described. The antenna device 101A includes two coil conductors 21 and 22 each including a coil opening and a planar conductor 10. The planar conductor 10 is, for example, a metal portion of a casing of an electronic apparatus. Each of the coil conductors 21 and 22 is disposed at an edge portion of the planar conductor 10 in a state of having a winding axis in a normal direction of the planar conductor 10. The planar conductor 10 has a symmetry center line shown by an alternate long and short dash line, and the coil conductors 21 and 22 are disposed at positions which are symmetrical about the center line of the planar conductor 10. The planar conductor is a conductive component having at least a portion which planarly spreads, and may be a surface of a curved surface shape or a cubic shape, other than a planar shape.

Figure 2:
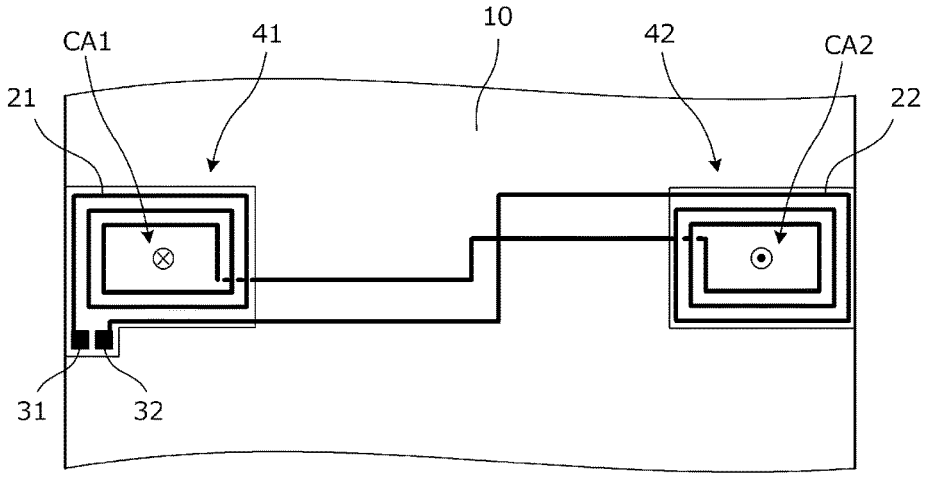
FIG. 2 is a plan view of a power supply coil.
Figure 3:
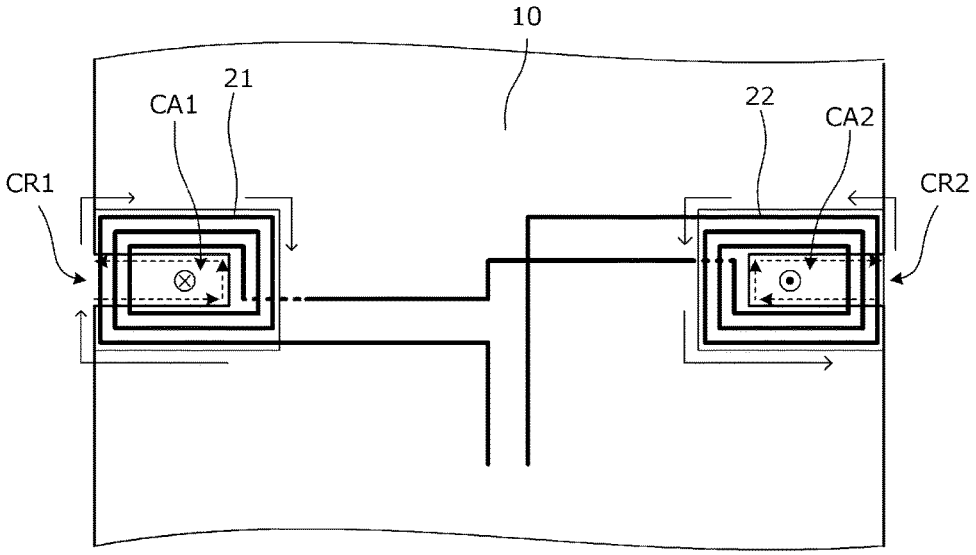
FIG. 3 is a schematic diagram showing a connection state of two coil conductors 21 and 22 and a current path.

FIG. 2 is a plan view of power supply coils, and FIG. 3 is a schematic diagram showing a connection state of the two coil conductors 21 and 22 and a current path. The coil conductors 21 and 22 are patterned on a single flexible board, and the flexible board and the coil conductors define power supply coils 41 and 42. In the example shown in FIG. 2, the coil conductors 21 and 22 are provided on the single flexible board, and the two power supply coils 41 and 42 are structured as a single component.

The coil conductor 21 and the coil conductor 22 are connected in series, and terminals 31 and 32 are extended therefrom. In addition, the two coil conductors 21 and 22 are connected such that magnetic fluxes generated at the respective coil conductors are in opposite phase with each other with respect to a principal surface direction of the planar conductor 10. A power supply circuit such as an RFIC is connected to the terminals 31 and 32.

As shown in FIG. 3, the planar conductor 10 includes opposing two sides, and includes cutout-shaped portions CR1 and CR2 recessed from each side toward the opposed side, and the coil openings CA1 and CA2 of the coil conductors 21 and 22 overlap the cutout-shaped portions CR1 and CR2 in a plan view.

If the antenna device 101A defines and functions as a transmitting antenna, when a current flows through the coil conductors 21 and 22 in a direction shown by solid arrows in FIG. 3, magnetic fluxes pass through the cutout-shaped portions CR1 and CR2 in a direction shown by a cross sign and a dot sign.

Figure 4A:
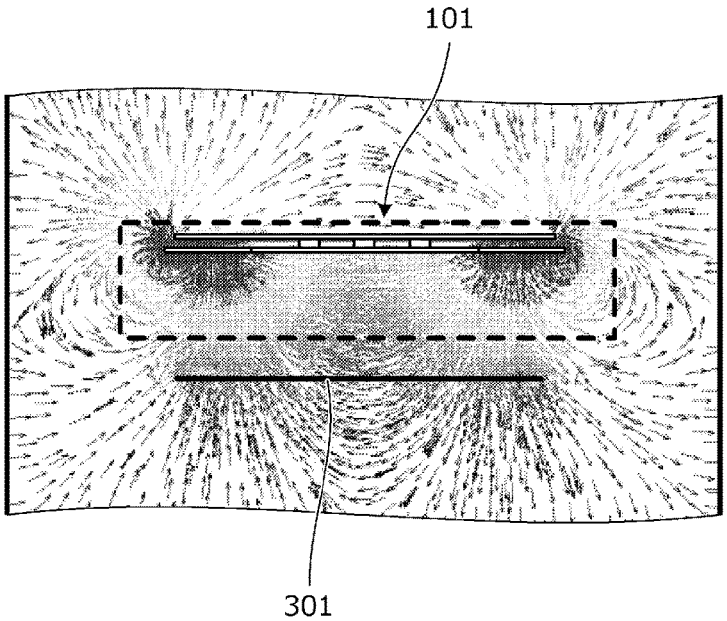
FIG. 4A is a diagram showing a distribution of a magnetic flux density around the antenna device of the first preferred embodiment of the present invention, showing a distribution of a magnetic flux density in a cross section taken along a broken line in FIG. 1A.
Figure 4B:
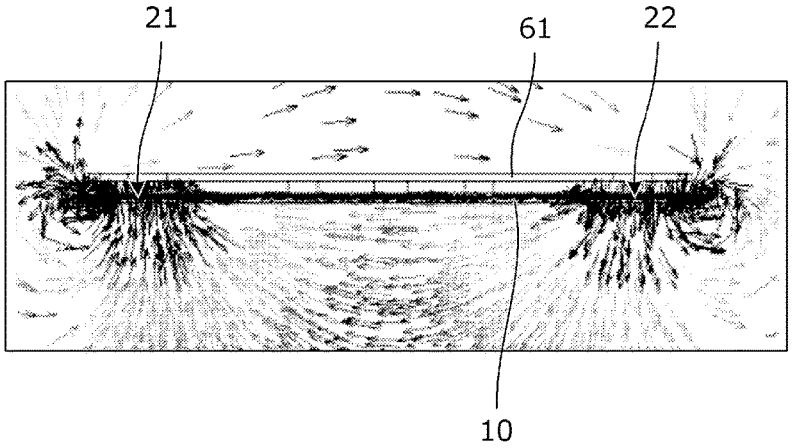
FIG. 4B is an enlarged view around the antenna device in FIG. 4A.

FIG. 4A is a diagram showing a distribution of a magnetic flux density around the antenna device of the present preferred embodiment, showing a distribution of a magnetic flux density in a cross section taken along a broken line in FIG. 1A. FIG. 4B is an enlarged view around the antenna device in FIG. 4A.

The planar conductor 10 is, for example, a metal portion of a casing, and the power supply coils are attached to the metal portion. Thus, as shown in FIG. 4B, the coil conductors 21 and 22 are disposed very closely to the planar conductor 10. FIGS. 4A and 4B also show a circuit board 61 within the casing.

As shown in FIG. 4A, a communication counterpart-side antenna coil 301 and the planar conductor 10 of the antenna device 101A are opposed to each other in a parallel or substantially parallel state.

As shown in FIGS. 4A and 4B, it is seen that the magnetic flux density is high not only near the two coil conductors 21 and 22 but also between the two coil conductors 21 and 22. Since the planar conductor 10 is present between the two coil conductors 21 and 22, each magnetic flux draws a large loop along the planar conductor 10 from near the opening of one of the coil conductors to near the opening of the other coil conductor. Thus, the magnetic flux density becomes high over a wide range of the planar conductor 10. In addition, because of the presence of the planar conductor 10, in a region facing the planar conductor, the directions of the magnetic fluxes are inverted only at the center between the two coil conductors 21 and 22. Thus, even when the communication counterpart-side antenna coil 301 moves parallel or substantially parallel relative to the planar conductor 10 of the antenna device 101A, the amount of change in the direction of each magnetic flux passing through the coil opening of the communication counterpart-side antenna coil 301 is small, and hence the number of null points is also small. In the case where the communication counterpart-side antenna coil 301 is located at the center between the two coil conductors 21 and 22 in a plan view as shown in FIG. 4A, the balance of the magnetic fluxes passing through the coil opening of the communication counterpart-side antenna coil 301 is 0, and hence this position becomes a null point. However, since the magnetic field intensity between the two coil conductors 21 and 22 is high, the antenna device 101A couples with the communication counterpart-side antenna coil 301 at any position that is even slightly shifted from the null point. In addition, if the parallel or substantially parallel relation of the antenna device 101A with the communication counterpart-side antenna coil 301 is eliminated (tilted), the antenna device 101A couples with the communication counterpart-side antenna coil 301.

Meanwhile, the antenna device 101B shown in FIG. 1B is an example of further including a coil conductor 25 in addition to the coil conductors 21 and 22. The coil conductor 25 is wound so as to extend around an opening OP formed in the planar conductor 10. The opening OP is connected to the outer edge of the planar conductor 10 via a slit SL.

Another antenna is provided by the planar conductor 10 including the opening OP and the slit SL and the coil conductor 25. That is, the antenna device 101B includes a first antenna defined by the coil conductors 21 and 22 and the planar conductor 10 and a second antenna defined by the coil conductor 25 and the planar conductor 10. The first antenna and the second antenna are preferably used for different communication systems.

Since at least a portion of the planar conductor 10 is disposed between the coil conductors of a plurality of the antennas as described above, the coil conductors almost do not electromagnetically couple with each other. Thus, the plurality of the antennas define and function as independent antennas.

For example, one of the above two communication systems may be used as a communication system such as NFC (13.56 MHz band), and the other communication system may be used as a communication system of 5 MHz or lower, or the like. In addition, both antennas may be for NFC communication, and may be separately used for different standards of NFC. Moreover, other than the communication systems, for example, one of the antennas may be used for a communication system such as NFC (13.56 MHz band), and the other antenna may be used as a power transmission antenna using a 6.78 MHz band such as A4WP (Alliance for Wireless Power).

In the antenna device 101A of the present preferred embodiment, the coil conductors 21 and 22 are disposed at the opposing edge portions of the planar conductor 10, but are not limited thereto. Coil conductors may be disposed at adjacent edge portions of the planar conductor 10, and may be driven such that magnetic fluxes are radiated in opposite phases. For example, in the antenna device 101B, the coil conductors 21, 22, may be driven as antennas for the same communication or power transmission system such that the magnetic fluxes of the coil conductors 21 and 22 are radiated in phase and the magnetic fluxes of the coil conductors 21 and 25 are radiated in opposite phase. If a planar conductor is disposed at least between two or more coil conductors for the same system, it is possible to provide an antenna device in which a null point is unlikely to occur.

In addition to the configurations described above, the following configurations may be provided.

FIG. 3 and other figures show an example where the cutout-shaped portions CR1 and CR2 are recessed from each side toward the opposed side of the planar conductor 10. However, the cutout-shaped portion may include an opening. That is, the cutout-shaped portion may have a structure such that the outer edge of the planar conductor and the opening are connected via a slit.

In the example shown in FIG. 1B, the first antenna including the coil conductors 21 and 22 and the second antenna including the coil conductor 25 are provided. However, the coil openings of these antennas may be disposed so as to at least partially overlap the cutout-shaped portion. That is, the coil conductors of the antennas for different systems (or different standards) may share the cutout-shaped portion.

Even with a configuration in which no opening or slit is provided in the planar conductor 10 and the coil openings of the antennas for different systems (or different standards) are disposed at positions outside the planar conductor 10, the above advantageous effects are similarly achieved.

Second Preferred Embodiment

Figure 5A:
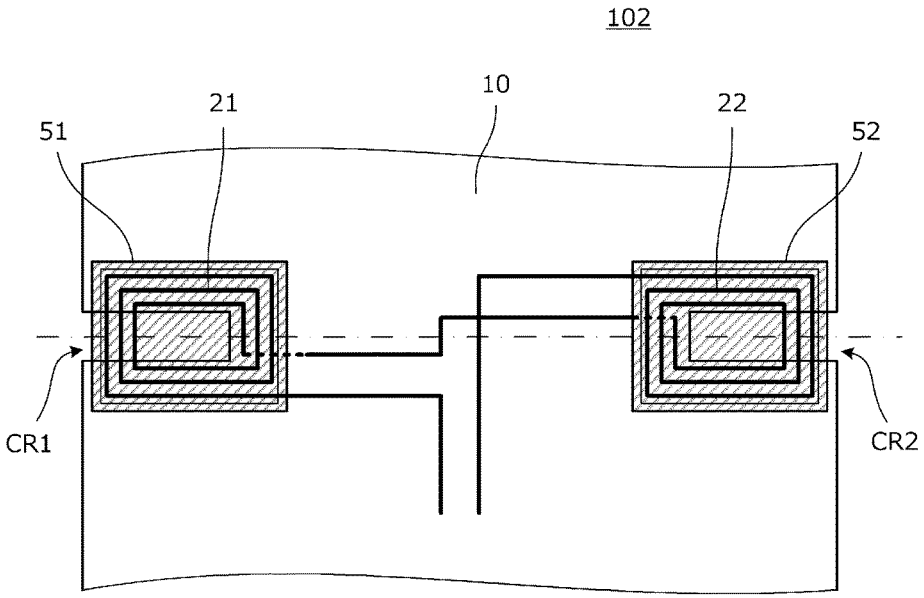
FIG. 5A is a plan view of an antenna device according to a second preferred embodiment of the present invention.
Figure 5B:
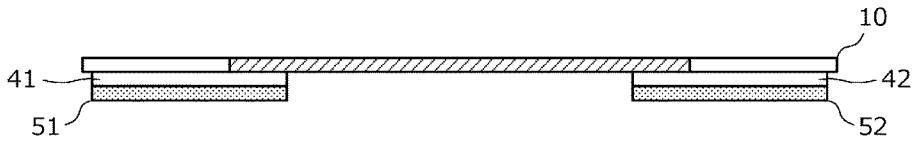
FIG. 5B is a cross-sectional view taken along an alternate long and short dash line in FIG. 5A.

FIG. 5A is a plan view of an antenna device 102 according to a second preferred embodiment of the present invention, and FIG. 5B is a cross-sectional view taken along an alternate long and short dash line in FIG. 5A. Magnetic sheets 51 and 52 are attached to the power supply coils 41 and 42 at the positions where the coil conductors 21 and 22 are formed. That is, the magnetic sheets 51 and 52 cover portions of the cutout-shaped portions CR1 and CR2 in a plan view.

Each of the magnetic sheets 51 and 52 is a ferrite sheet, and is a sintered magnetic ferrite with a sheet shape or a ferrite resin sheet in which magnetic ferrite powder is dispersed in a resin material.

Since the magnetic sheets 51 and 52 cover portions of the cutout-shaped portions CR1 and CR2 in a plan view as described above, the cutout-shaped portions CR1 and CR2 are magnetically shielded by the magnetic sheets 51 and 52, so that unnecessary radiation is significantly reduced or prevented. In addition, in the case where another conductor is close to the coil conductors 21 and 22, an eddy current which tends to occur in this conductor is significantly reduced or prevented. Furthermore, the inductances of the coil conductors 21 and 22 increase, thus it is possible to obtain a predetermined inductance with a small number of turns, and it is possible to ensure a large coil opening because of the small number of turns.

Third Preferred Embodiment

Figure 6:
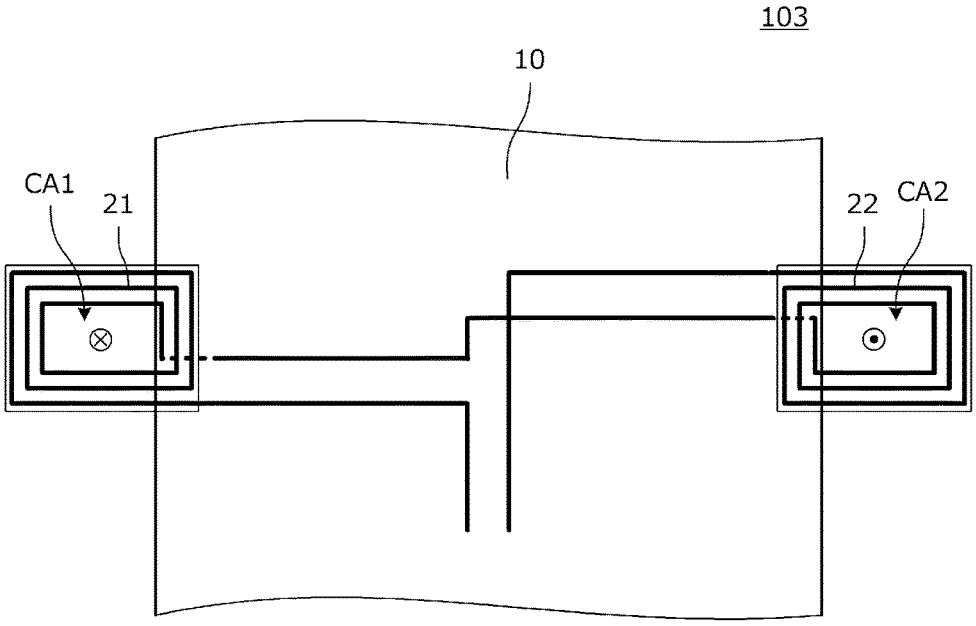
FIG. 6 is a plan view of an antenna device according to a third preferred embodiment of the present invention.

FIG. 6 is a plan view of an antenna device 103 according to a third preferred embodiment of the present invention. The coil conductors 21 and 22 are each patterned on a flexible board. Unlike the first and second preferred embodiments, in the present preferred embodiment, no cutout-shaped portion is provided in the planar conductor 10.

Even with such a structure, since the planar conductor 10 is disposed between the coil conductors 21 and 22, each magnetic flux draws a large loop along the planar conductor 10 from near the opening of one of the coil conductors to near the opening of the other coil conductor, similarly to the first and second preferred embodiments.

Fourth Preferred Embodiment

In a fourth preferred embodiment of the present invention, some modifications of the antenna devices described in the first to third preferred embodiments will be described.

Figure 7:
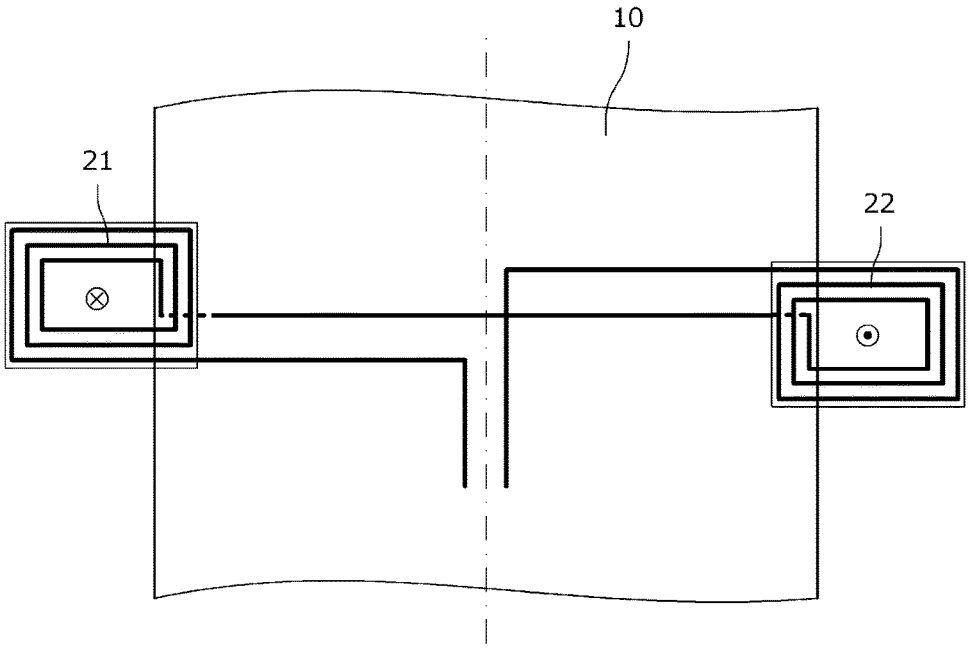
FIG. 7 is a plan view of an antenna device according to a fourth preferred embodiment of the present invention.

FIG. 7 is a plan view of an antenna device according to the fourth preferred embodiment. The planar conductor 10 includes two opposing sides, and portions of the coil conductors 21 and 22 overlap the planar conductor 10. Unlike the preferred embodiments described so far, the coil conductors 21 and 22 are disposed so as to be asymmetrical about the center line of the planar conductor 10 (an alternate long and short dash line). Thus, it is possible to increase the interval between the two coil conductors 21 and 22, and it is possible to expand a range where communication is possible.

Figure 8:
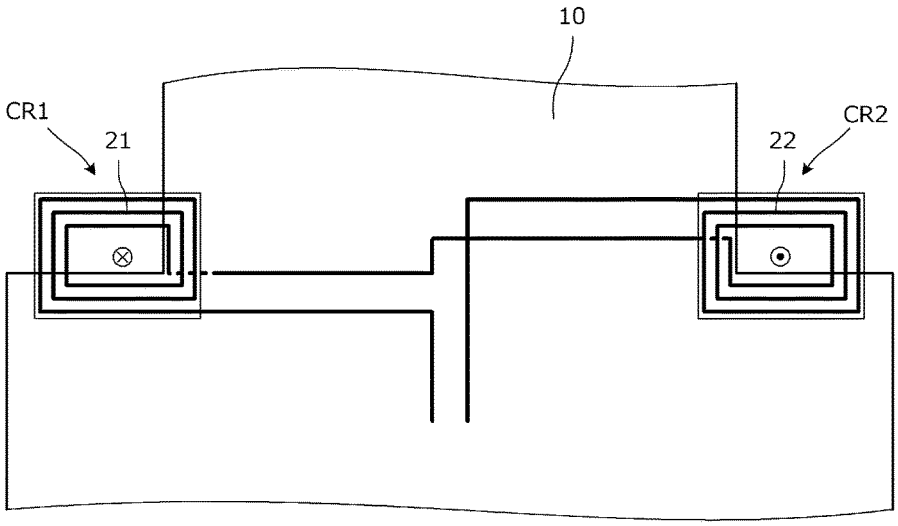
FIG. 8 is a plan view of another antenna device according to the fourth preferred embodiment of the present invention.

FIG. 8 is a plan view of another antenna device according to the fourth preferred embodiment. In this example, the coil conductor 21 is disposed such that two sides of the coil conductor 21 extend along two sides of the cutout-shaped portion CR1 provided in the planar conductor 10. Similarly, the coil conductor 22 is disposed such that two sides of the coil conductor 22 extend along two sides of the cutout-shaped portion CR2. Even with such a structure, since the planar conductor 10 is disposed between the coil conductors 21 and 22, each magnetic flux draws a large loop along the planar conductor 10 from an area near the opening of one of the coil conductors to an area near the opening of the other coil conductor.

Figure 9:
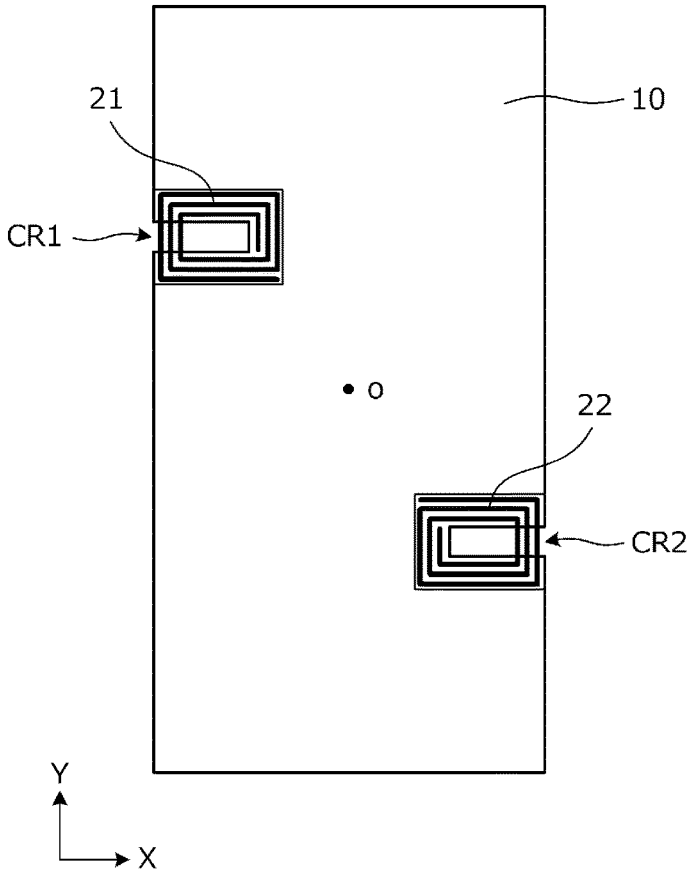
FIG. 9 is a plan view of another antenna device according to the fourth preferred embodiment of the present invention.

FIG. 9 is a plan view of still another antenna device according to the fourth preferred embodiment. In this example, the planar conductor 10 has a symmetry center point o, and the coil conductors 21 and 22 are disposed at positions which are symmetrical about the center point o of the planar conductor 10. Thus, it is possible to increase the interval between the two coil conductors 21 and 22 which have point symmetry, and it is possible to expand a range where communication is possible.

Figure 10:
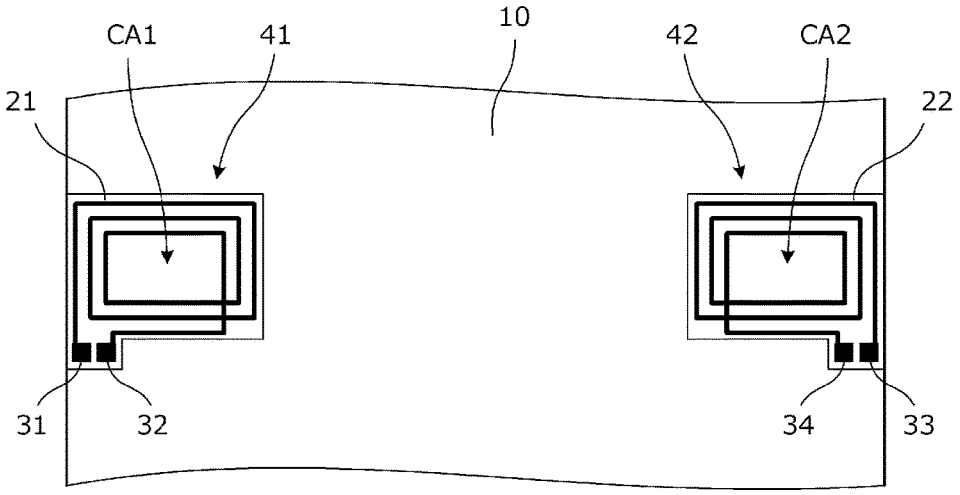
FIG. 10 is a plan view of another antenna device according to the fourth preferred embodiment of the present invention.

FIG. 10 is a plan view of still another antenna device according to the fourth preferred embodiment. Although the two coil conductors 21 and 22 are provided on a single flexible board in the example shown in FIG. 2, the power supply coils 41 and 42 are separate components. The two power supply coils 41 and 42 are attached to, for example, a metal portion of a casing, and pin terminals (pogo pins) provided on the circuit board are brought into contact with the terminals 31, 32, 33, and 34. With this structure, the number of flexible boards taken increases, and thus it is possible to reduce the cost.

Fifth Preferred Embodiment

FIGS. 11A, 11B, 11C, and 11D are plan views of antenna devices 105A, 105B, 105C, and 105D according to a fifth preferred embodiment of the present invention. In each of these antenna devices, the cutout-shaped portions CR1, CR2, CR3, and CR4 are provided at four locations on the periphery of the planar conductor 10. The coil conductors 21, 22, 23, and 24 are disposed such that the coil openings CA1, CA2, CA3, and CA4 of the coil conductors 21, 22, 23, and 24 overlap the cutout-shaped portions CR1, CR2, CR3, and CR4 in a plan view.

Figure 11A:
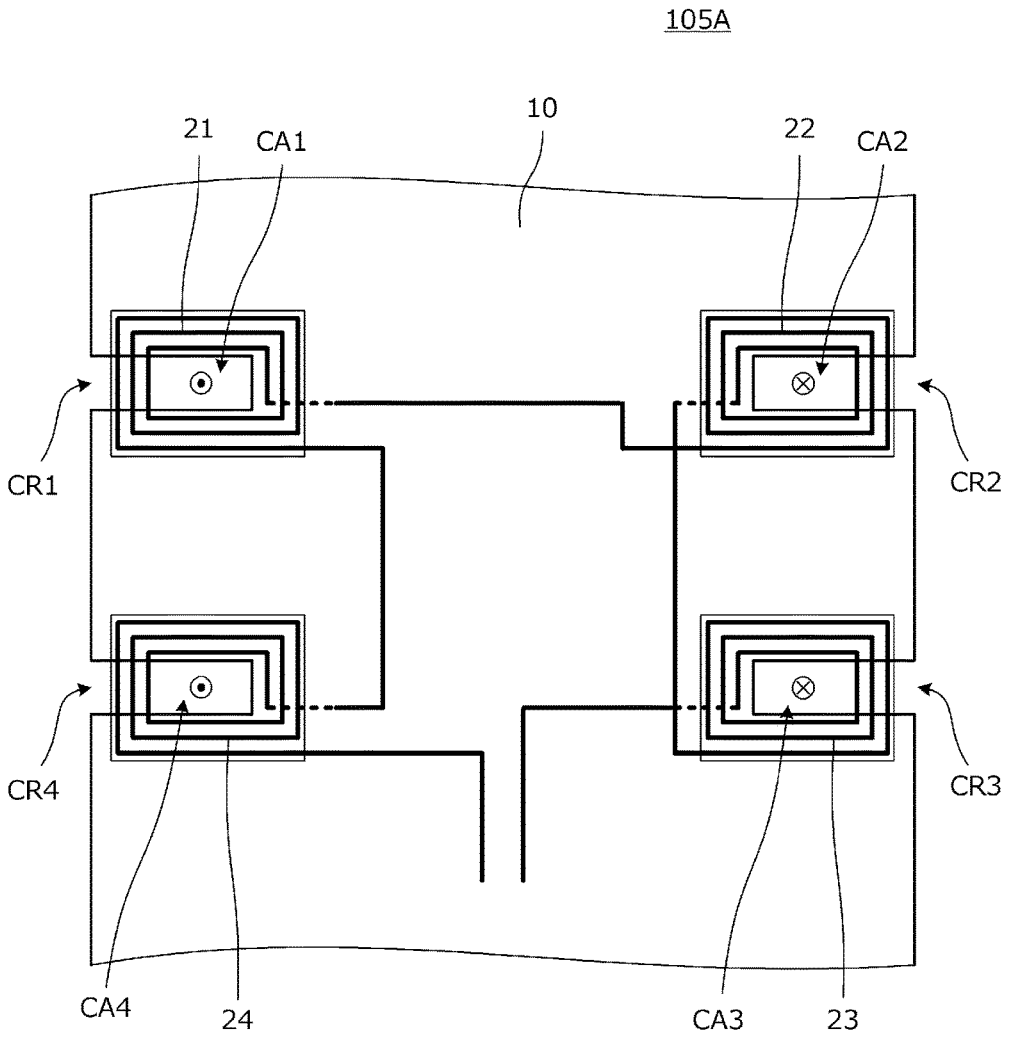
FIG. 11A is a plan view of an antenna device 105A according to a fifth preferred embodiment of the present invention.

In the antenna device 105A shown in FIG. 11A, the coil conductors 21, 22, 23, and 24 are connected in series such that the magnetic fluxes generated at the coil conductors 21 and 24 are in phase with each other, the magnetic fluxes generated at the coil conductors 22 and 23 are in phase with each other, and the magnetic fluxes generated at the coil conductors 21 and 22 are in opposite phase with each other.

Figure 11B:
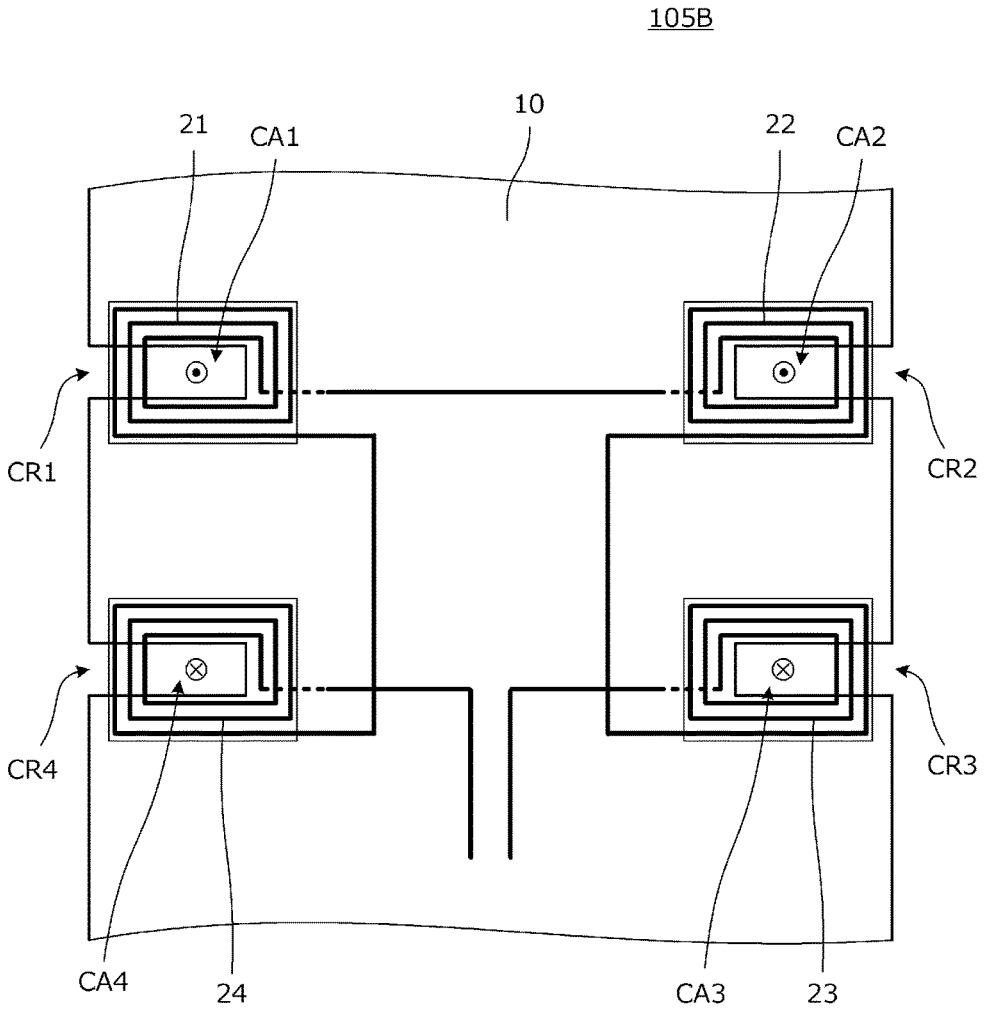
FIG. 11B is a plan view of an antenna device 105B according to the fifth preferred embodiment of the present invention.

In the antenna device 105B shown in FIG. 11B, the coil conductors 21, 22, 23, and 24 are connected in series such that the magnetic fluxes generated at the coil conductors 21 and 22 are in phase with each other, the magnetic fluxes generated at the coil conductors 23 and 24 are in phase with each other, and the magnetic fluxes generated at the coil conductors 21 and 24 are in opposite phase with each other.

Figure 11C:
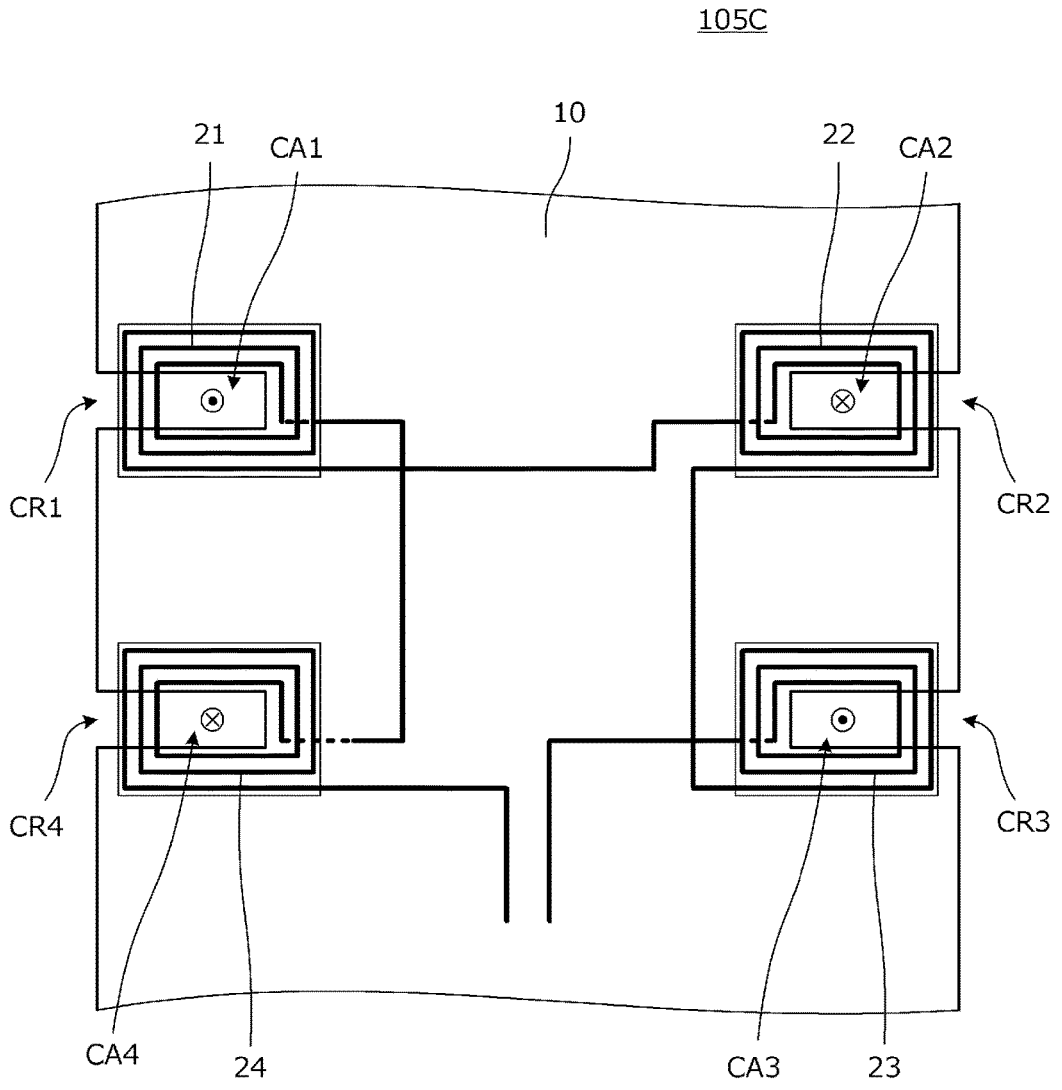
FIG. 11C is a plan view of an antenna device 105C according to the fifth preferred embodiment of the present invention.

In the antenna device 105C shown in FIG. 11C, the coil conductors 21, 22, 23, and 24 are connected in series such that the magnetic fluxes generated at the coil conductors 21 and 23 are in phase with each other, the magnetic fluxes generated at the coil conductors 22 and 24 are in phase with each other, and the magnetic fluxes generated at the coil conductors 21 and 22 are in opposite phase with each other.

Figure 11D:
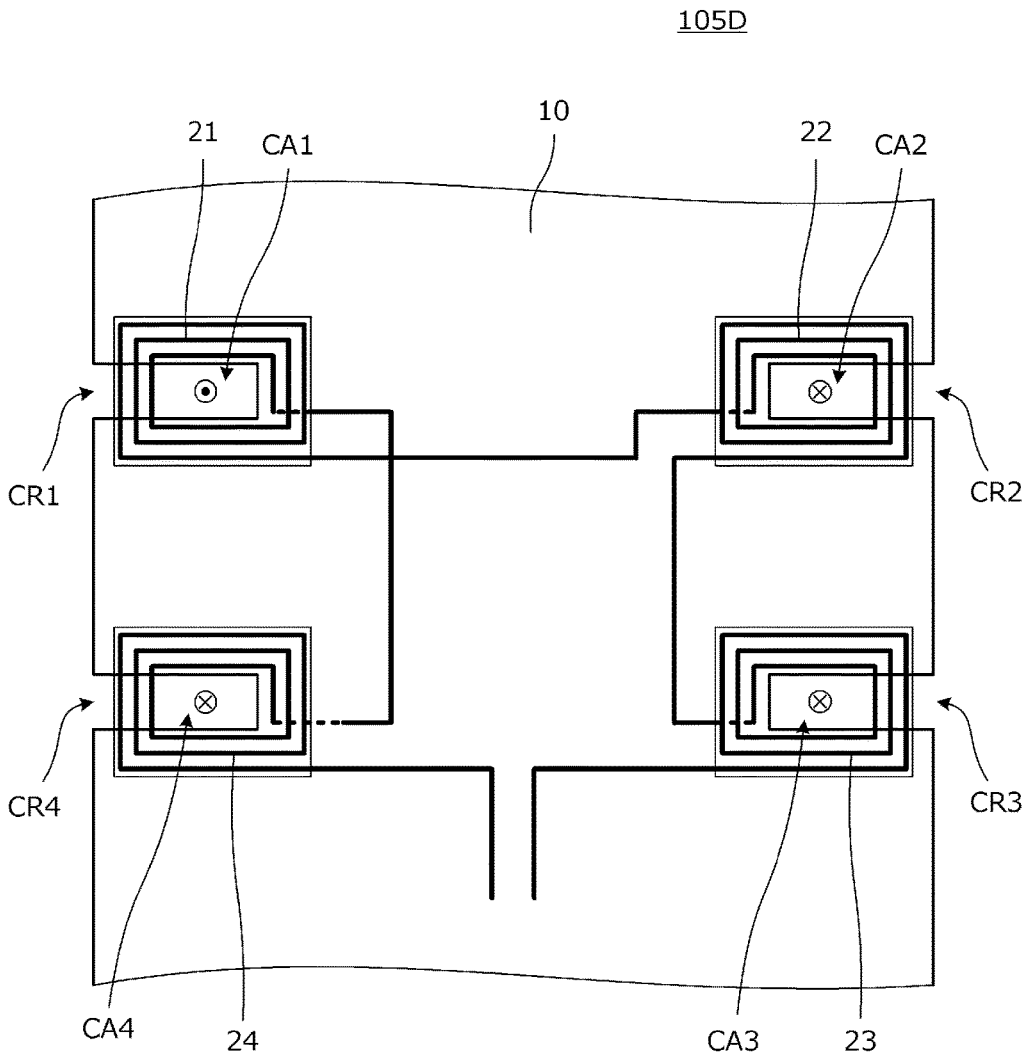
FIG. 11D is a plan view of an antenna device 105D according to the fifth preferred embodiment of the present invention.

In the antenna device 105D shown in FIG. 11D, the coil conductors 21, 22, 23, and 24 are connected in series such that the magnetic fluxes generated at the coil conductors 22, 23, and 24 are in phase with each other, and the magnetic fluxes generated at the coil conductors 21 and 22 are in opposite phase with each other.

The characteristics of each antenna device are as follows.

Antenna Device 105A

A magnetic flux loop which is large in the lateral direction in FIG. 11A is provided.

Antenna Device 105B

A magnetic flux loop which is large in the vertical direction in FIG. 11B is provided.

Antenna Device 105C

A magnetic flux loop which is large in both of the vertical and lateral directions in FIG. 11C is provided.

Antenna Device 105D

A magnetic flux loop which is large in the vertical direction, the lateral direction, an oblique direction in FIG. 11D is provided.

As described above, three or more coil conductors may be included. Because of this, it is possible to increase the size of a magnetic flux loop, and it is possible to set directivity of the antenna.

Sixth Preferred Embodiment

Figure 12:
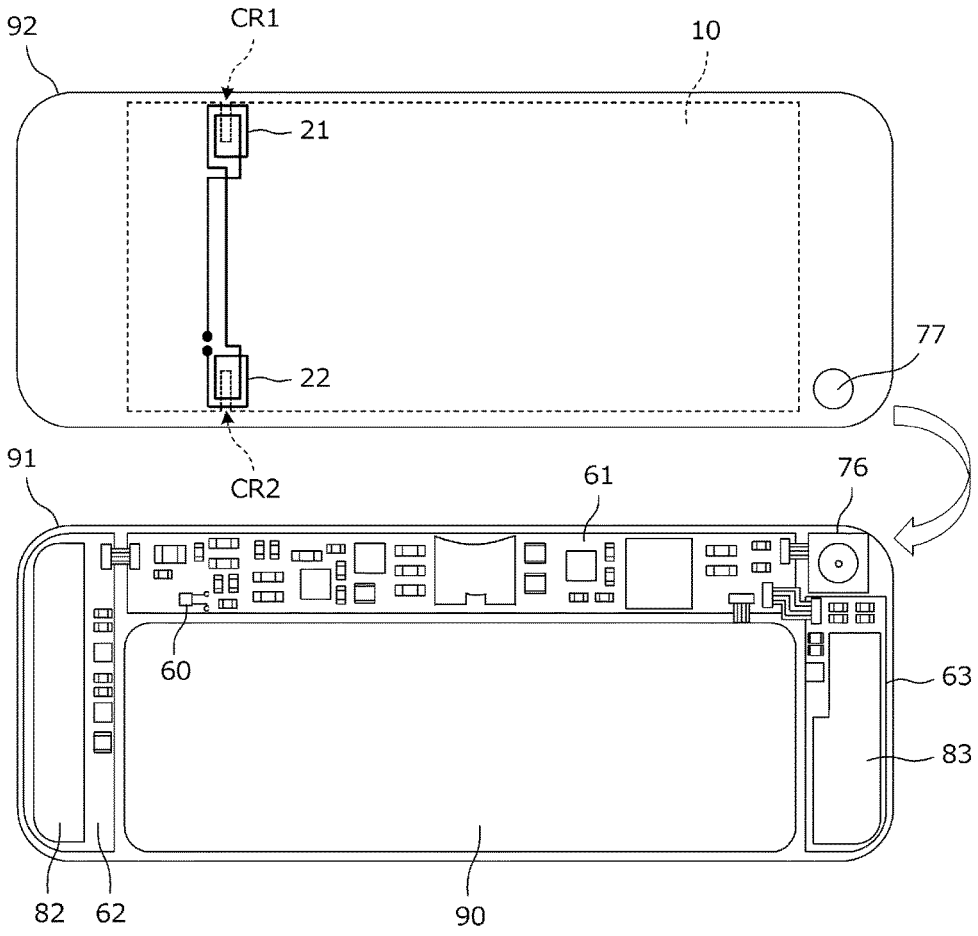
FIG. 12 is a plan view showing the internal structure of a casing of a communication terminal apparatus according to a sixth preferred embodiment of the present invention.

FIG. 12 is a plan view showing the internal structure of a casing of a communication terminal apparatus according to a sixth preferred embodiment of the present invention. The communication terminal apparatus is an example of an electronic apparatus according to a preferred embodiment of the present invention. Within an upper casing 91, circuit boards 61, 62, and 63, a battery pack 90, a camera module 76, and the like are housed. On the circuit board 61, an RFIC 60 including a communication circuit, a resonance capacitor, and the like are mounted. On the circuit boards 62 and 63, UHF-band antennas 82 and 83 and the like are provided.

A lower casing 92 includes an opening 77 through which a lens of the camera module 76 is optically exposed. In addition, the lower casing 92 is made of a resin, and the planar conductor 10 including a metal film is provided on the inner surface of the lower casing 92. The cutout-shaped portions CR1 and CR2 are provided in the planar conductor 10, and the coil conductors 21 and 22 are disposed at the positions of the cutout-shaped portions CR1 and CR2. The coil conductors 21 and 22 and the planar conductor 10 define an antenna device. When the lower casing 92 is fitted to the upper casing 91, the antenna device is connected to the RFIC 60 via pogo pins provided on the circuit board 61.

Seventh Preferred Embodiment

Figure 13:
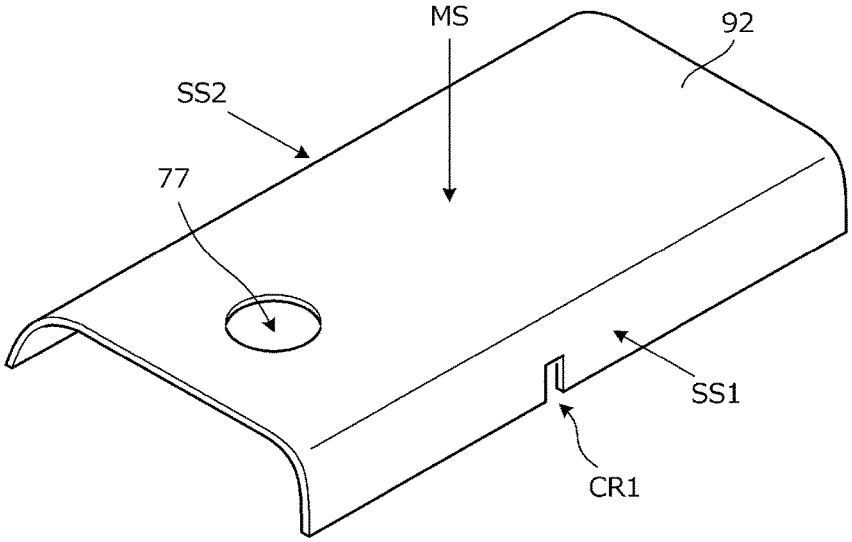
FIG. 13 is a perspective view of a lower casing of an electronic apparatus according to a seventh preferred embodiment of the present invention.

FIG. 13 is a perspective view of a lower casing of an electronic apparatus according to a seventh preferred embodiment of the present invention. In the present preferred embodiment, a metallic casing is preferably used as a planar conductor, that is, as a radiator of an antenna device. The lower casing 92 is a molded body which is a metal plate, includes a principal surface MS and bent surfaces SS1 and SS2 connected to the principal surface MS, and includes a camera module opening 77 provided in the principal surface MS. The cutout-shaped portion CR1 for an operation button is provided in the one bent surface SS1 of the lower casing 92. Although the operation button is not shown in FIG. 13, the operation button is provided so as to be exposed from the cutout-shaped portion CR1 to the outside. A similar cutout-shaped portion is provided also in the other bent surface SS2.

Similarly to each preferred embodiment described so far, an antenna device is provided by disposing coil conductors at the two cutout-shaped portions.

According to the present preferred embodiment, by using the cutout-shaped portion for the operation button, it is possible to easily dispose a plurality of coil conductors such that portions of the coil conductors overlap a metal portion of a casing and portions of the coil openings do not overlap the metal portion of the casing. That is, it is unnecessary to provide a dedicated cutout-shaped portion in the metal portion of the casing in order to dispose the coil conductors as described above, and thus it is possible to significantly reduce or prevent a decrease in the mechanical strength of the metal portion. In addition, since the bent surfaces are included, the effective area of the planar conductor increases, and a range where communication is possible widens.

In the present preferred embodiment, the operation button is disposed at the cutout-shaped portion, but a device such as a slide switch, a connector that provides connections to the outside, a speaker, a light-emitting device, and various sensors such as an optical sensor and a fingerprint sensor may be disposed at the cutout-shaped portion.

In addition, in the present preferred embodiment, the two cutout-shaped portions of the planar conductor are respectively provided in the two bent surfaces connected to the principal surface, but a structure may be provided in which only one of the cutout-shaped portions is provided in one of the bent surfaces and a region of the planar conductor in which the other cutout-shaped portion is provided is not bent with respect to the principal surface.

Eighth Preferred Embodiment

Figure 14:
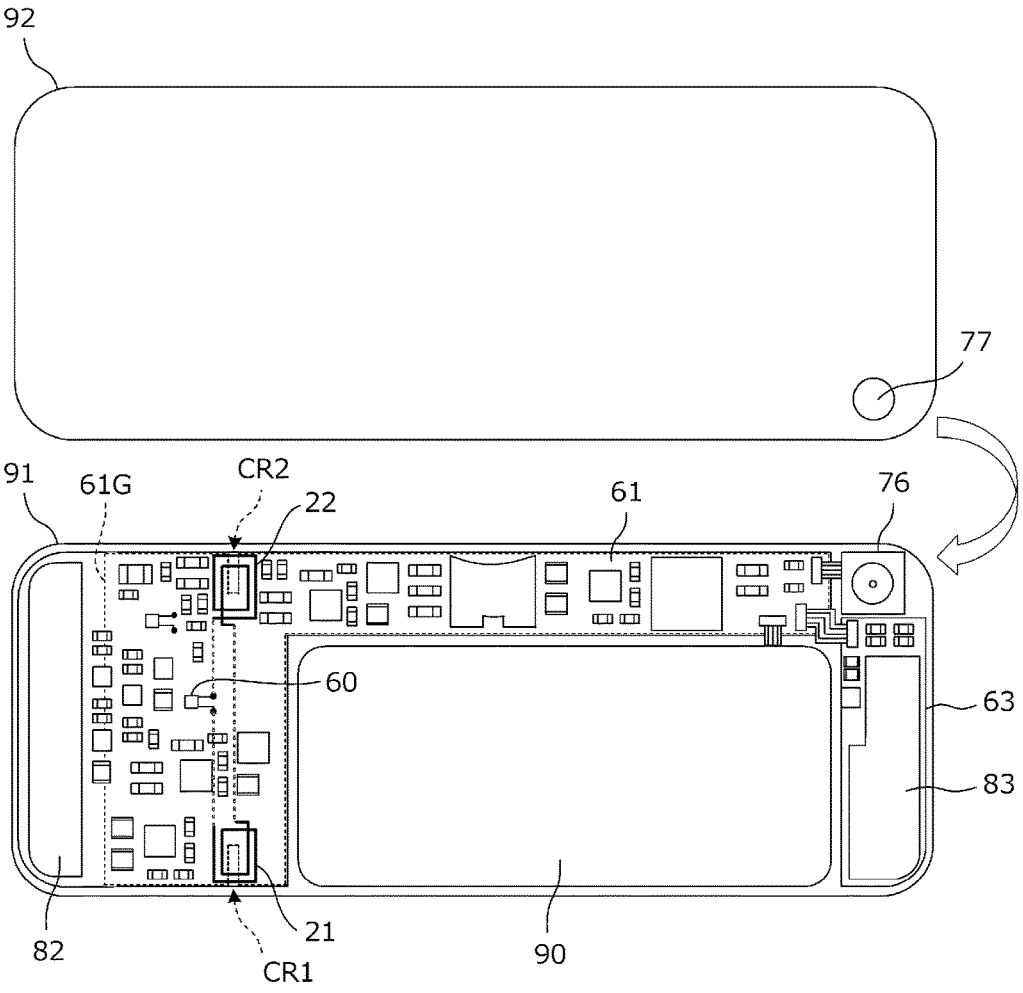
FIG. 14 is a plan view showing the internal structure of a casing of a communication terminal apparatus according to an eighth preferred embodiment of the present invention.

FIG. 14 is a plan view showing the internal structure of a casing of a communication terminal apparatus according to an eighth preferred embodiment of the present invention. The communication terminal apparatus is an example of an electronic apparatus according to a preferred embodiment of the present invention. Within the upper casing 91, the circuit boards 61 and 63, the battery pack 90, the camera module 76, and the like are housed. On the circuit board 61, the RFIC 60 including a communication circuit, the resonance capacitor, and the like are mounted. On the circuit boards 61 and 63, the UHF-band antennas 82 and 83 and the like are provided. In addition, a ground pattern 61G is provided on the circuit board 61. The ground pattern 61G is an example of a planar conductor according to a preferred embodiment of the present invention. The cutout-shaped portions CR1 and CR2 are provided in the ground pattern, and the coil conductors 21 and 22 are disposed at the positions of the cutout-shaped portions CR1 and CR2. The coil conductors 21 and 22 and the ground pattern 61G define an antenna device. The coil conductors 21 and 22 may be conductor patterns on the circuit board 61.

Other Preferred Embodiments

In each of various preferred embodiments of the present invention described above, the example is shown in which a plurality of coil conductors are connected in series, but the coil conductors may be connected in parallel or substantially parallel. In addition, the planar conductor may not be rectangular as shown in FIG. 14.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a plurality of coil conductors each including a coil opening; and a planar conductor that is a separate and independent conductor from the plurality of coil conductors; wherein the plurality of coil conductors and the planar conductor are integrated in the same antenna device;

the plurality of coil conductors are disposed at edge portions of the planar conductor such that winding axes of the coil conductors extend in a normal direction of the planar conductor;

the plurality of coil conductors are connected such that magnetic fluxes generated at the respective coil conductors are in opposite phase with each other; and in a plan view, portions of the plurality of coil conductors overlap the planar conductor, and in the plan view, portions of the coil openings do not overlap the planar conductor.

2. The antenna device according to claim 1, wherein the portions of the plurality of coil conductors that overlap the planar conductor are disposed along an outer edge of the planar conductor in a plan view.

3. The antenna device according to claim 1, wherein at least two coil conductors of the plurality of coil conductors are disposed at positions which are symmetrical about a center line extending in a predetermined direction of the planar conductor, in a plan view.

4. The antenna device according to claim 1, wherein at least two coil conductors of the plurality of coil conductors are disposed at positions which are symmetrical about a center point of the planar conductor, in a plan view.

5. The antenna device according to claim 1, wherein the planar conductor includes two opposing sides, and includes cutout-shaped portions recessed from each side toward the opposed side, and the coil openings of the respective coil conductors overlap the cutout-shaped portions in a plan view.

6. The antenna device according to claim 5, wherein the planar conductor includes a principal surface and bent surfaces connected to the principal surface, and the cutout-shaped portions are provided in the bent surfaces.

7. The antenna device according to claim 5, further comprising a magnetic sheet covering at least a portion of each of the cutout-shaped portions in a plan view.

8. An electronic apparatus comprising:

an antenna device; and a power supply circuit connected to the antenna device; wherein the antenna device includes a plurality of coil conductors each including a coil opening and a planar conductor that is a separate and independent conductor from the plurality of coil conductors;

the plurality of coil conductors and the planar conductor are integrated in the same antenna device;

the plurality of coil conductors are disposed at edge portions of the planar conductor such that winding axes of the coil conductors extend in a normal direction of the planar conductor;

the plurality of coil conductors are connected such that magnetic fluxes generated at the respective coil conductors are in opposite phase with each other;

in a plan view, portions of the plurality of coil conductors overlap the planar conductor, and in the plan view, portions of the coil openings do not overlap the planar conductor; and the planar conductor defines and functions as a metal portion of a casing.

9. The electronic apparatus according to claim 8, wherein the metal portion of the casing includes a principal surface and a bent surface connected to the principal surface, a cutout-shaped portion for a device is provided in the bent surface, and the coil opening of at least one coil conductor of the plurality of coil conductors overlaps the cutout-shaped portion.

10. The electronic apparatus according to claim 8, wherein the portions of the plurality of coil conductors that overlap the planar conductor are disposed along an outer edge of the planar conductor in a plan view.

11. The electronic apparatus according to claim 8, wherein at least two coil conductors of the plurality of coil conductors are disposed at positions which are symmetrical about a center line extending in a predetermined direction of the planar conductor, in a plan view.

12. The electronic apparatus according to claim 8, wherein at least two coil conductors of the plurality of coil conductors are disposed at positions which are symmetrical about a center point of the planar conductor, in a plan view.

13. The electronic apparatus according to claim 8, wherein the planar conductor includes two opposing sides, and includes cutout-shaped portions recessed from each side toward the opposed side, and the coil openings of the respective coil conductors overlap the cutout-shaped portions in a plan view.

14. The electronic apparatus according to claim 13, wherein the planar conductor includes a principal surface and bent surfaces connected to the principal surface, and the cutout-shaped portions are provided in the bent surfaces.

15. The electronic apparatus according to claim 13, further comprising a magnetic sheet covering at least a portion of each of the cutout-shaped portions in a plan view.

16. An electronic apparatus comprising:

an antenna device; and a power supply circuit connected to the antenna device; wherein the antenna device includes a plurality of coil conductors each including a coil opening and a planar conductor that is a separate and independent conductor from the plurality of coil conductors;

the plurality of coil conductors and the planar conductor are integrated in the same antenna device;

the plurality of coil conductors are disposed at edge portions of the planar conductor such that winding axes of the coil conductors extend in a normal direction of the planar conductor;

the plurality of coil conductors are connected such that magnetic fluxes generated at the respective coil conductors are in opposite phase with each other;

in a plan view, portions of the plurality of coil conductors overlap the planar conductor, and in the plan view, portions of the coil openings do not overlap the planar conductor; and the planar conductor is a portion of a conductor provided on a circuit board.

17. The electronic apparatus according to claim 16, wherein the metal portion of the casing includes a principal surface and a bent surface connected to the principal surface, a cutout-shaped portion for a device is provided in the bent surface, and the coil opening of at least one coil conductor of the plurality of coil conductors overlaps the cutout-shaped portion.

18. The electronic apparatus according to claim 16, wherein the portions of the plurality of coil conductors that overlap the planar conductor are disposed along an outer edge of the planar conductor in a plan view.

19. The electronic apparatus according to claim 16, wherein at least two coil conductors of the plurality of coil conductors are disposed at positions which are symmetrical about a center line extending in a predetermined direction of the planar conductor, in a plan view.

20. The electronic apparatus according to claim 16, wherein at least two coil conductors of the plurality of coil conductors are disposed at positions which are symmetrical about a center point of the planar conductor, in a plan view.

* * * * *